United States Patent [19]

Loveland et al.

[11] 4,323,251

[45] Apr. 6, 1982

[54] TARGET HOLDER

[76] Inventors: William A. Loveland, 904 66th. Ave. West, Bradenton, Fla. 33507; James S. Dukes, 8403 Byron La., Sarasota, Fla. 33580; Gregory W. Sparks, 3701 19th St. West, Bradenton, Fla. 33505

[21] Appl. No.: 121,059

[22] Filed: Feb. 13, 1980

[51] Int. Cl.[3] ..... F41J 1/10

[52] U.S. Cl. ..... 273/407; 24/139

[58] Field of Search ..... 273/407, 393; 40/11 A, 40/603, 604, 606, 607; 24/139, 139.1, 261 F

[56] References Cited

U.S. PATENT DOCUMENTS

| | | | |
|---|---|---|---|
| 831,367 | 9/1906 | Morris et al. | 24/139 UX |
| 1,245,756 | 11/1917 | Melhart | 24/139 UX |
| 1,260,969 | 1/1918 | Cramer | 24/139 |
| 2,538,118 | 1/1951 | Miller | 273/407 |
| 3,039,770 | 6/1962 | Ferretti | 273/402 X |
| 3,591,180 | 7/1971 | Lafon | 273/393 |

*Primary Examiner*—Anton O. Oechsle

*Attorney, Agent, or Firm*—William M. Hobby, III

[57] ABSTRACT

A target holder is provided with a circular frame connected with a slip fit to an elongated pole which terminates in a pointed end. Target holders are provided around the circumference of the frame made of steel spring rod which are wrapped around the frame and terminate in opposed elongated portions with criss-crossing angularly displaced projections to hold a paper target in place. The target holders slide freely about the circular frame when no targets are in position, but lock on the frame because of friction when the target is secured by the clips.

2 Claims, 5 Drawing Figures

TARGET HOLDER

BACKGROUND OF THE INVENTION

This invention relates to target holders in general, and more in particular to target holders that are portable.

Many different designs for holding paper or cardboard targets exist in the prior art. Most designs seek to accomplish two desired qualities, mainly the capability of adapting to targets of various sizes, and lightweight and cheap construction. One such existing device was described in U.S. Pat. No. 2,538,118 (Miller, 6/10/49). There, a pair of spring or leaf spring members are attached to a U-frame, and a pair of clips are attached to the end of the leaf spring members. In another configuration in U.S. Pat. No. 2,722,420 (Adamson, 11/01/55), an inverted U-frame is provided with a plurality of spring members disposed along the periphery and having a clamp disposed at the end of each spring member for securing the target. A similar construction can be found in U.S. Pat. No. 3,080,166, (Clark, 3/05/63), which provides a U-frame having a plurality of clamps disposed along the periphery thereof. In all of these patents the clamps or clips provided are standard clips, including opposite disposed gripping arms pivotally supported and urged toward each other by spring means or a tubular retainer and are usually made of a number of parts which are put together in some manufacturing process. There are a number of disadvantages with this type of design, including the cost of the manufacture of the clips, and the fact that the clips must be secured to the frame by welding or some other means, which could result in the detachment of the clamp, and reduce the overall usefulness of the system.

SUMMARY OF THE INVENTION

In order to overcome the disadvantages of the existing systems, a target holder is provided having an integral, substantially circular frame, terminating in two outwardly disposed radial projections which terminate in curved end pieces. The projections and curved end pieces are slipped into a pair of holes on a cap which is attached to an elongated pole terminating at a pointed end. A plurality of steel spring clips are disposed along the circumference of the circular frame, each of which is made of an integral piece of spring metal which has a helically wrapped section with a minimal clearance around the circular frame and two opposed projecting members provided disposed toward the same side relative to the frame.

The projecting members are angularly displaced relative to the frame to secure the target. The projecting members are compressed against the target by the spring force provided by the helically wrapped section. The clearance provided to the helically wrapped section is such that when the target is not in place the clip is free to slide on the frame, but once the target is mounted the clearance disappears and the clip is frictionally fixed to the frame.

BRIEF DESCRIPTION OF THE DRAWINGS

Further details are explained below with the help of the examples illustrated in the attached drawings, in which.

DETAILED DESCRIPTION OF THE INVENTION

Figure 1:
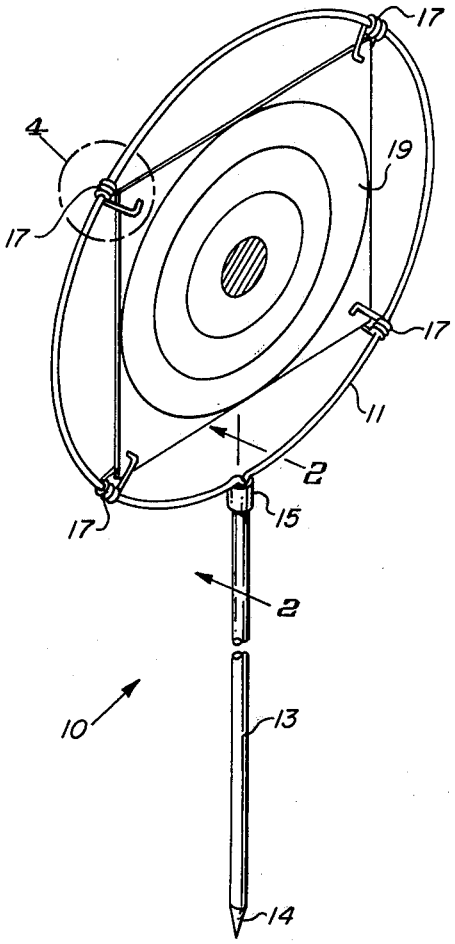
FIG. 1 is an overall view of the target holder of the present invention.

In FIG. 1, the target holder 10 of the present invention is illustrated having a circular frame 11 connected to an elongated pole 13 having a pointed end portion 14. The frame 11 is connected to the pole 13 by means of a coupling element 15. Disposed around the circumference of the circular frame are four spring clips 17 which are used to secure a paper or cardboard target 19 firmly in place.

Figure 2:
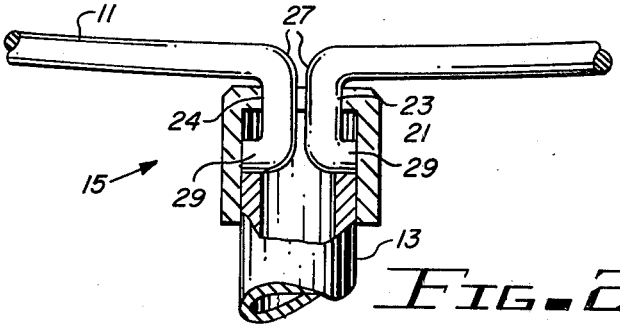
FIG. 2 is a detailed cross section showing how the circular frame is attached to the elongated pole.

The coupling member 15 is illustrated in FIG. 2, and consists of a cylindrical cap 21 which is provided with two holes 23 and 24. The circular cap 21 is rigidly attached to the pole 13 by conventional means. The end of the frame 11 are bent outwardly to provide a substantially radial projection 27 at each end, and the radial projection 27 is further bent to provide a bent end piece 29. Frame 11 is held in place by the tension developed by the circular frame and is locked in place by the end pieces 29.

Figure 3:
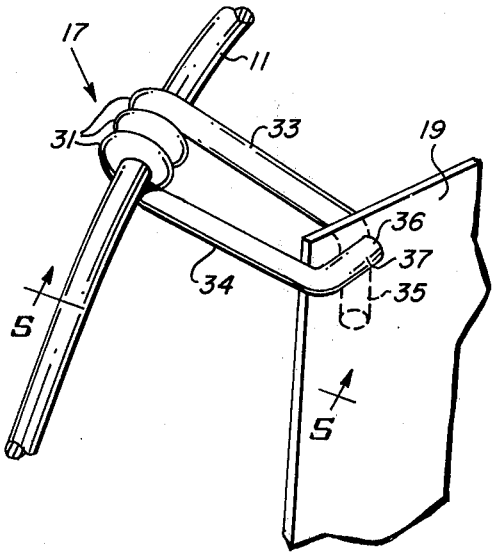
FIG. 3 shows the integrally formed spring clip.
Figure 5:
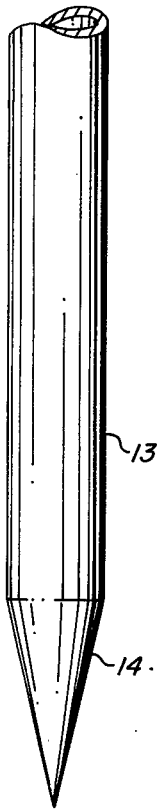
FIG. 5 shows the pointed end of the pole.

As shown in FIG. 3, the spring clip 17 is made of an integral piece of spring metal which is wrapped a plurality of helical turns 31 around the circular frame 11 and provided with a minimal clearance. The clip is provided with two projecting members 33 and 34. The ends of projecting members 33 and 34 are bent toward each other through an angle to provide opposing end sections 35 and 36 which criss-cross each otheer at a point 37. The target 19 is held securely in place by the spring action of the spring clip 17 at point 37, and the end sections 35 and 36 provide a laterally restraining surface to further secure the target.

Figure 4:
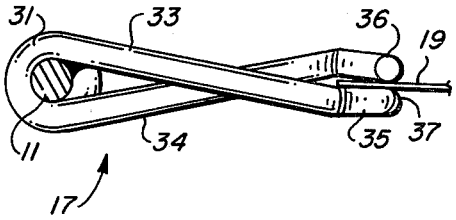
FIG. 4 is a side view of the clip.

The geometry of the clips 17 is best illustrated by reference to FIG. 4 which shows a side view of clip 17. Reference is made to a plane defined by the target 19. Projecting member 33 originates at a point above the plane of the target 19 and terminates in end section 35 which is below the plane of the target 19. Similarly, projecting member 34 originates at a point below the plane of target 19 and terminates in end section 36, which lies above the plane of the target 19. This construction results in end sections 35 and 36 being compressed against each other by the spring action of the turns 31, and the helical turns 31 having a minimal clearance to enable the sliding of the clip 17 on the circular frame 11, when the target 19 is not in place. When the target is inserted between end sections 35 and 36, the angular displacement of the projecting members 33 and 34 result in the reduction of the inside diameter of the helical turns 31, which in turn, decreases the minimal clearance and increases the friction between the helical turns 31 and the frame 11 thereby fixing the clip 17 relative to the frame 11.

Finally, as shown in FIG. 6, the elongated pole 13 terminates in a pointed end portion 14 which is adapted to be inserted into the ground.

I claim:

1. A target holder for mounting a target comprising:

an elongated pole having one end terminating in a pointed end portion;

a cap secured to the other end of the elongated pole, said cap having two openings at a top end thereof;

a substantially circular metal frame with two radially outwardly projecting arm sections terminating in a bent end portion, said outwardly projecting end members disposed through the openings in said cap and restrained by the tension provided by the substantially circular frame; and a plurality of means for securing the target, each means for securing being slidably mounted on the circular metal frame when the target is not secured, and being frictionally fixed to the circular metal frame when the target is secured, and said means for securing also having an integral piece of material having a first projecting member, a helical section that is wound around the frame with a predetermined minimal clearance at a predetermined level of compression, and a second projecting member, said first and second members being disposed on the same side of the frame and capable of being angularly displaced when the target is mounted so that the first projecting member originates below a plane defined by the target and terminates above the plane, and said second projecting member originates above the plane and terminates below the plane whereby the two projecting members are compresssed against the target by a spring force generated by the helical section and the helical section is reduced in inside diameter and is frictionally fixed to the frame, whereby targets of different sizes can be mounted by sliding each means for securing to a desired position prior to mounting the target.

2. The target holder of claim 1 wherein the ends of each of said projecting members are oppositely bent substantially parallel to the plane to criss-cross each other at a point.

* * * * *